US008590745B2

(12) United States Patent
Filho et al.

(10) Patent No.: US 8,590,745 B2
(45) Date of Patent: Nov. 26, 2013

(54) PROVIDED IN A LIQUID DISPENSER

(75) Inventors: Mario Gnypek Filho, Curitiba (BR); Jacques E. Miranda, Curitiba (BR); Rodrigo Telles Wolff, Curitiba (BR); Lizandro Chrestenzen, Curitiba (BR); Luis Fernando Zeni Filho, Curitiba (BR); Adriano Davin, Curitiba (BR)

(73) Assignee: Electrolux do Brasil S.A., Curitiba (BR)

( * ) Notice: Subject to any disclaimer, the term of this patent is extended or adjusted under 35 U.S.C. 154(b) by 0 days.

(21) Appl. No.: 13/382,948

(22) PCT Filed: Jul. 7, 2010

(86) PCT No.: PCT/BR2010/000218

§ 371 (c)(1),
(2), (4) Date: Mar. 27, 2012

(87) PCT Pub. No.: WO2011/003161

PCT Pub. Date: Jan. 13, 2011

(65) Prior Publication Data

US 2012/0180517 A1 Jul. 19, 2012

(30) Foreign Application Priority Data

Jul. 9, 2009 (BR) ..... 0902376

(51) Int. Cl.
*B65D 5/66* (2006.01)

(52) U.S. Cl.
USPC ..... 222/113; 222/146.1

(58) Field of Classification Search
USPC ..... 222/113, 129, 129.1, 146.1, 146.6; 62/264, 389
See application file for complete search history.

(56) References Cited

U.S. PATENT DOCUMENTS

| | | | | |
|---|---|---|---|---|
| 2,633,959 | A | 4/1953 | Von Stoeser | |
| 8,006,502 | B2 * | 8/2011 | Kim et al. | 62/66 |
| 2009/0007585 | A1 | 1/2009 | Kim et al. | |
| 2010/0126194 | A1 * | 5/2010 | Flores et al. | 62/126 |

FOREIGN PATENT DOCUMENTS

| | | |
|---|---|---|
| WO | 02081356 | 10/2002 |

OTHER PUBLICATIONS

International Search Report for PCT/BR2010/000218, dated Apr. 1, 2011, 2 pages.

* cited by examiner

*Primary Examiner* — Lien Ngo
(74) *Attorney, Agent, or Firm* — Pearne & Gordon LLP

(57) ABSTRACT

An improvement in a liquids dispensing means comprising a niche for accommodating a container to be filled with liquid, the niche being associated with the outer panel (12) of a cabinet, being lighted from the rear wall thereof (21, 56), a part of the light flux impinging on a window provided with a sheet of translucent material (29) located in the closing means (21, 51) of the niche, the window being in substantial alignment/register with the lighting means (36, 37, 54) provided on the rear wall.

11 Claims, 5 Drawing Sheets

PROVIDED IN A LIQUID DISPENSER

FIELD OF THE INVENTION

The present invention relates to an improvement provided in liquid dispensers, and more particularly to the water dispensers located in niches accessible from the outside of refrigerator cabinets.

DESCRIPTION OF THE PRIOR ART

Currently, a large number of refrigerators are equipped with iced water or ice dispensers that may be used by the users without requiring the opening of the main door of the refrigerator. In addition to the advantage of a more comfortable use, such dispensers provide a reduction in electric power consumption, since the opening of the door would cause the loss of a substantial amount of cold air from the refrigerated cabinet, thereby requiring the activation of the compressor to return the temperature within the cabinet to its normal values. The said dispensers are normally located on the front door of the cabinets and are configured in the form of niches or recesses in which are inserted or supported the containers or drinking glasses to be filled with the liquid.

Thus, for example, patent document No. WO2007/027072 proposes a dispenser system, located on the outer face of the refrigerator door that dispenses either iced water or ice depending on a selection made by the user. The dispenser is configured as a niche, wherein the user inserts a container such as a cup or a glass, and the liquid or the ice are poured into the cited container by way of an appropriate nozzle. One of the disadvantages associated with this dispenser resides in the fact of the same being directly exposed to the environment, thereby facilitating the ingress of dirt and/or microorganisms, and therefore requiring periodic cleaning thereof.

For the purpose of overcoming such disadvantages, U.S. Pat. No. 7,137,272 proposes a small rectangular swinging door coupled to the niche by means of a shaft near the lower edge of the corresponding opening and having a pair of supporting struts whose first ends are hinged with the sides of the small door and whose second ends slide within side channels in the walls of the cavity or niche. On opening thereof, the cited small door projects outwardly while remaining in the horizontal position, thereby forming a support for the cups or glasses. As such, it is subjected to vertical strains arising from the provision of support to objects or to human support, being thereby subjected to a possible breakage of the suspension system and excessive wear of the elements that make up the same.

In patent document No. PI0703959-0 there is proposed a dispenser comprising a niche inserted in the front face of the front door of the cabinet, which frontal opening is closed by a panel that pivots vertically between first and a second positions. According to the illustration of FIG. 1 of the instant application, in the first position the panel 11 is positioned substantially on the same plane of the front face 12. In the second position, which is illustrated in FIG. 2, the panel 11 is recessed with relation to the face, in order to configure a niche in the shape of a parallelepiped box of shallow depth, open at the front face thereof and closed at its rear face by the panel, wherein is provided at its upper part the end 14 of the iced water dispensing tube, the control thereof being provided by means of a user-operated button 13. The upper and lower horizontal panels of the said box are provided with rotary coupling means to the front door, forming a virtual vertical axis 15 about which the box-shaped assembly rotates between the first and second positions, the latter being the dispenser's utilization position. In order to facilitate this utilization, a part of the lower horizontal panel 16 protrudes outwardly in order to form a semi-circular support 17 for a container during the filling of the latter.

At certain times or under conditions in which there is poor ambient light or none at all, the use of the previously described dispensers entails some disadvantages. Thus, when the control is performed by the user by pressing a button or equivalent means, the poor visibility of the surface of the liquid in these conditions might lead the user to interrupt the dispensing of liquid before the proper time, or otherwise that same poor visibility might lead such user to keep the activating button pressed until the capacity of the container is exceeded, with the consequent occurrence of spilling. The switching on of the lighting in the room where the refrigerator is located will avoid the problem cited above, in addition to allowing a proper placement of the container inside the niche of the dispenser. However, such switching on of the lights entails an increase in electric power consumption, in addition to requiring an increased attention on the part of the user, who must not forget to turn off the light when leaving the room.

OBJECTS OF THE INVENTION

In light of what has been set forth above, the present invention is aimed at avoiding an inadequate filling of the container with the liquid, due to the absence of adequate lighting.

One other objective consists in facilitating the location of the dispenser in environments with poor lighting or no lighting at all.

BRIEF DESCRIPTION OF THE INVENTION

The objectives cited herein, as well as others, are achieved by the invention by means of the inclusion in the dispenser of a lighting means, which in addition to illuminating the inside of the dispenser niche, provided an external signaling indicating the location of the dispenser, facilitating the location thereof by the user without requiring such user to switch on the main lighting of the room.

According to another characteristic of the invention, the lighting means is activated automatically when the dispenser is used.

According to another characteristic of the invention, the lighting means comprises at least one electroluminescent element that illuminates the inside of the dispenser niche, installed on the wall of the niche.

According to another characteristic of the invention, the dispenser comprises a niche of substantially parallelepiped shape, with a shallow depth, which main face constitutes the panel that closes the front opening of the niche, the panel being provided with a translucent window through which passes the light flux originated from the lighting means in order to illuminate the inside of the said niche.

According to another characteristic of the invention, the box may be rotated about a vertical axis between a first and a second, the first constituting the usage position in which the niche is oriented toward the front of the cabinet with its opening accessible to the user, and the second being the closed position, in which the panel is located closely adjacent to the plane of the front face of the cabinet.

According to another characteristic of the invention, in the usage position, the translucent window is juxtaposed to the lighting means, remaining substantially aligned or in register with this means when in the closed position.

According to another characteristic of the invention, a control circuit drives the lighting means.

According to another characteristic of the invention, the control circuit detects the presence of the user.

DESCRIPTION OF THE FIGURES

Other objects, aspects, advantages and characteristics of the invention will become more evident from the detailed description of a preferred embodiment of the invention and of the figures that refer thereto, in which.

DETAILED DESCRIPTION OF THE INVENTION

Figure 1:
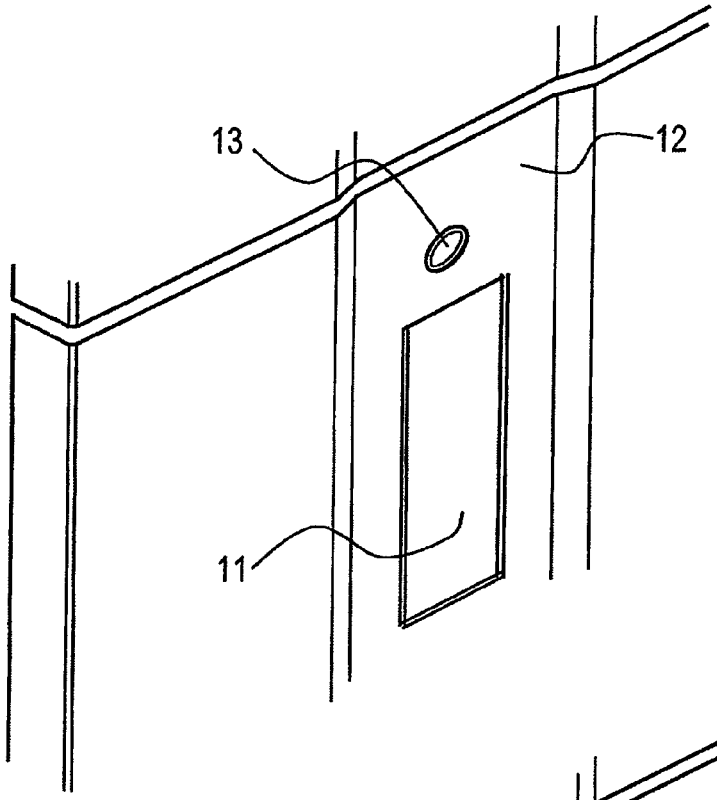
Fig. 1 Prior Art
FIGS. 1 and 2 show a dispenser configured in accordance with the prior art.
Figure 2:
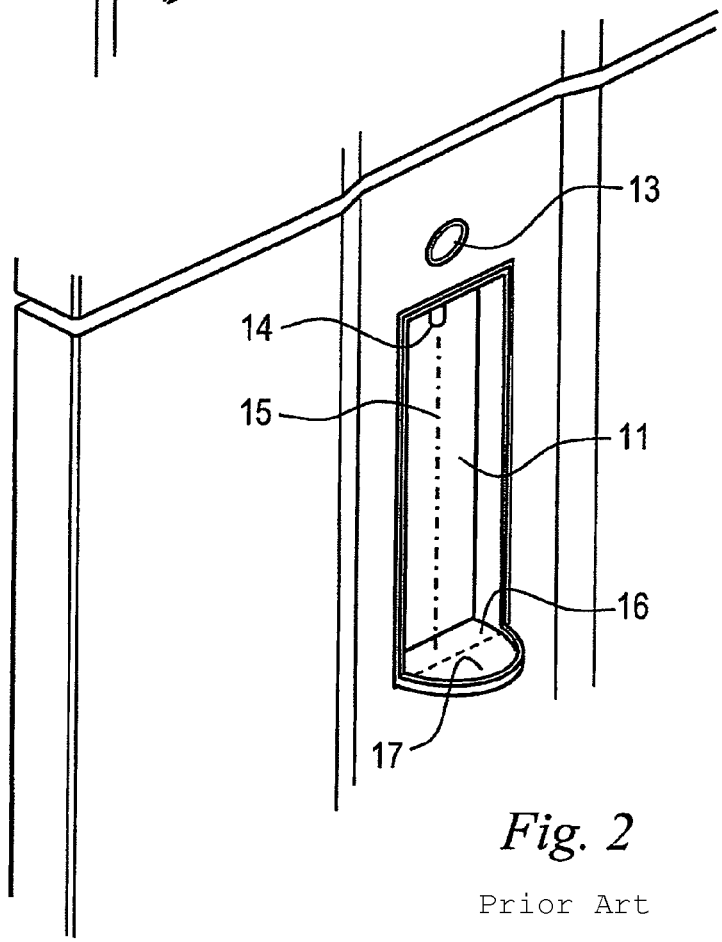
Fig. 2 Prior Art
Figure 3:
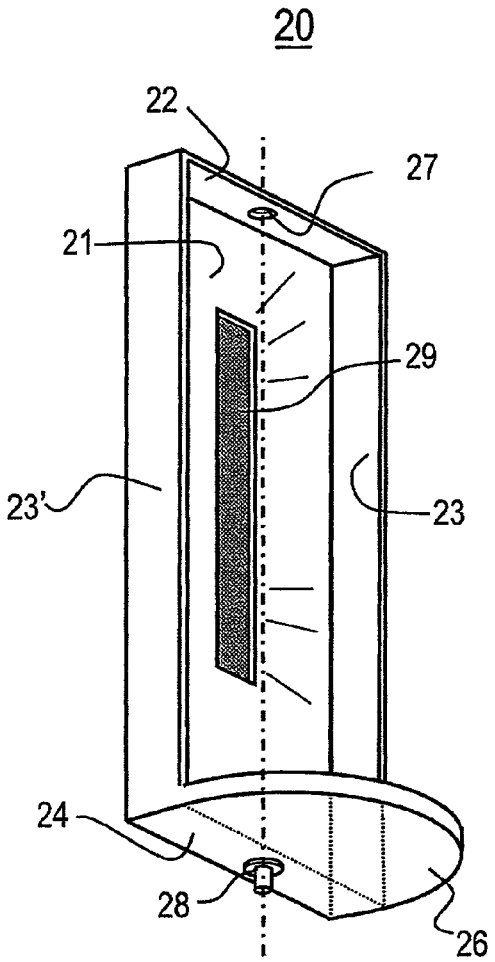
FIG. 3 shows the box of substantially parallelepiped shape that forms the niche of the dispenser, formed by the closing panel and its perimeter flaps, according to the principles of the invention.

Now referring to FIG. 3, the dispenser comprises a rotary assembly 20 in the shape of a parallelepiped box of shallow depth, comprising a larger vertical panel 21, two vertical panels 23 and 23' and two horizontal panels, an upper horizontal panel 22 and a lower horizontal panel 24, the latter being provided with an extension in the shape of a semi-circular flap 26. The assembly formed by panels 21, 22, 23, 23' and 24 with its flap 26 constitutes the niche wherein is accommodated the container intended to be filled with the liquid. The upper horizontal panel 22 is provided at the center thereof with a through hole 27 through which is projected the liquid supply tube when this assembly is mounted on the refrigerator door. The lower horizontal panel is provided at the center thereof with a supporting pin 28, which together with the hole 27 defines the vertical axis of rotation of the rotary assembly 20. Further according to the invention, the larger panel 21 is provided, along the vertical central axis thereof, with a window formed by a narrow aperture of rectangular shape, which is closed by a plate of translucent material 29 such as polycarbonate, acrylic, or an equivalent material.

Figure 4:
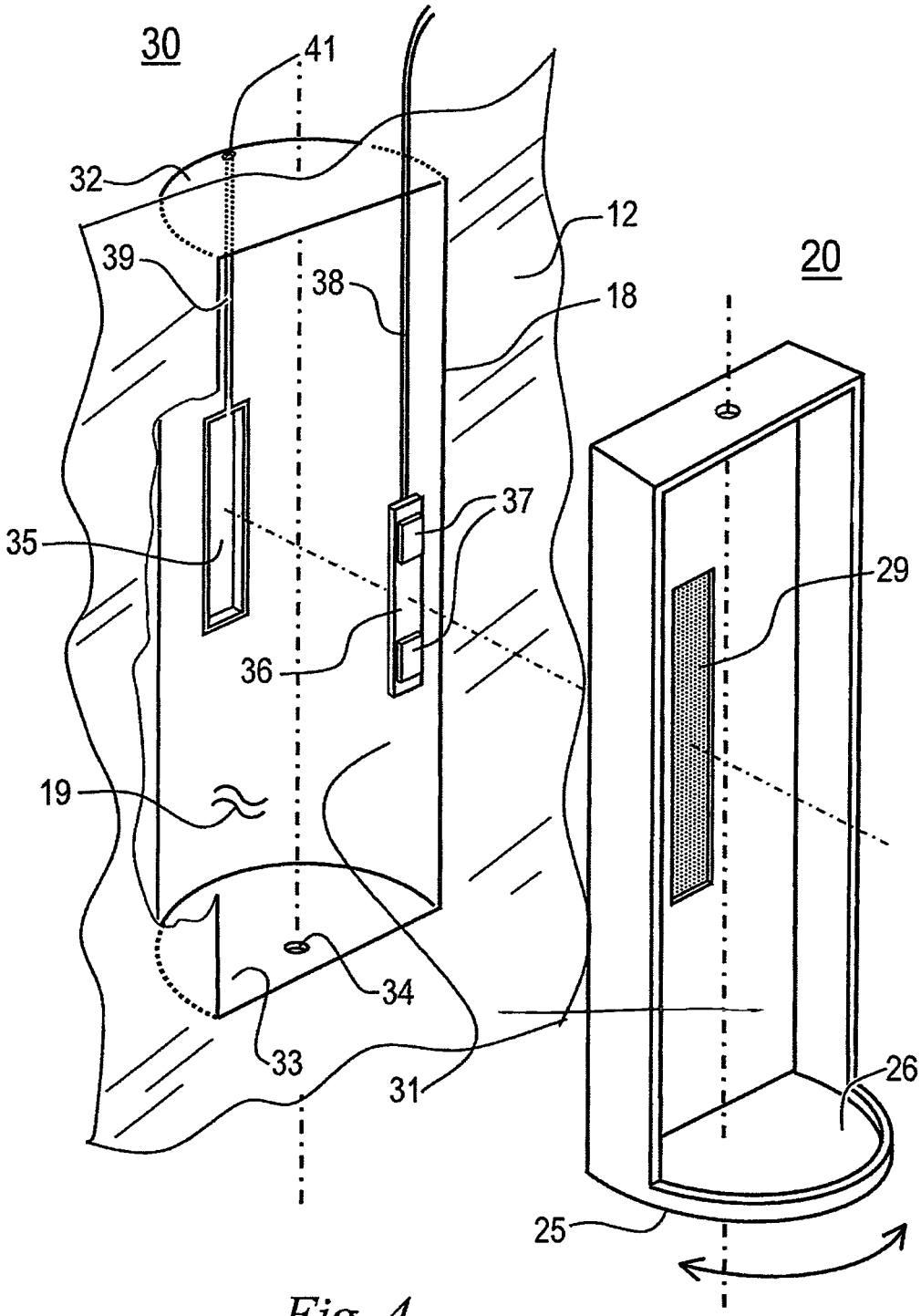
FIG. 4 is an exploded view showing the relationship between the main parts of the dispenser.

The exploded view of FIG. 4 shows a simplified view of the main elements of the dispenser, which comprises, in addition to the rotary assembly 20, a substantially semi-cylindrical cavity 19 which extends into the door of the refrigerator from the rectangular cutout 18 opened on the front panel 12, the said cutout having sufficient size to accommodate the dispensing assembly. The cavity is delimited by a curved panel 31 that forms the side of the cylinder, an upper base 32 and a lower base 33 which is provided with pin engaging means 34 for the pin 28 (visible in FIG. 3). The perimeter of the lower base 33 is slightly larger than the perimeter 25 of the flap 26, allowing the accommodation of the latter and its free rotational movement when the rotary assembly 20 is engaged in the cavity 19. The wall 31 is provided with a recess 35, located about halfway up its height, wherein is engaged the lighting subassembly 36 comprising one or more electroluminescent elements 37. In the exemplary embodiment under discussion, there is/are used one or more light emitting diodes (LEDs), which can be of the conventional or the SMD types. Other functionally equivalent components may be used for the production of light.

A control circuit (not shown) located externally with relation to the dispenser drives the diodes by means of the conductors 38, which enter the cavity 19 through the hole 41, and are lodged in a groove 39 along the course between the hole 41 and the recess 35. According to the principles of the invention, the recess containing the lighting subassembly 36 remains substantially aligned or in register with the window 29 of the rotary assembly 20 when it is in its usage position, shown in FIG. 5, such that the light flux emitted by the LEDs 37 passes through the said window in order to illuminate the niche formed by the rotary in this position.

Figure 7:
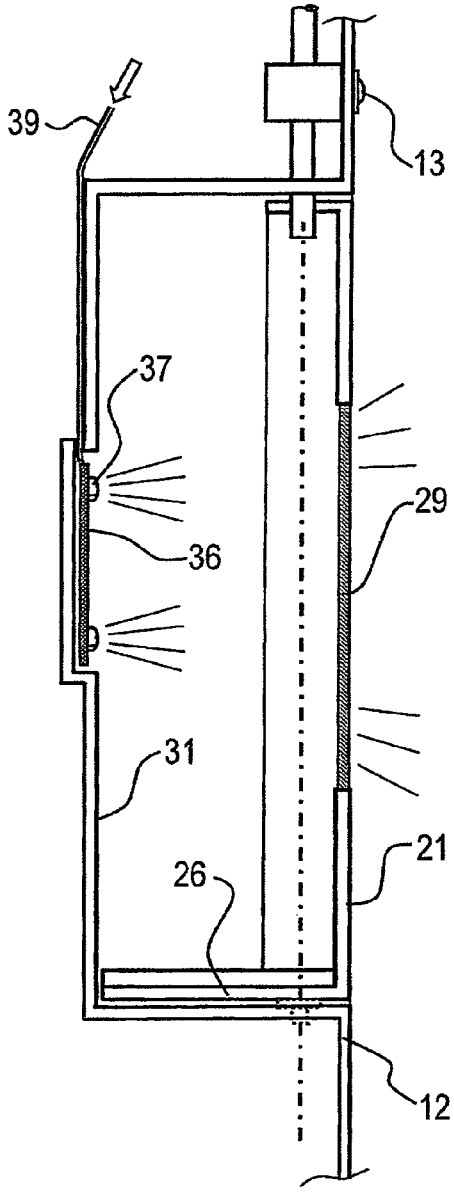
FIG. 7 shows a cross-sectional view of the dispenser, in the closed position, according to the principles of the invention.
Figure 5:
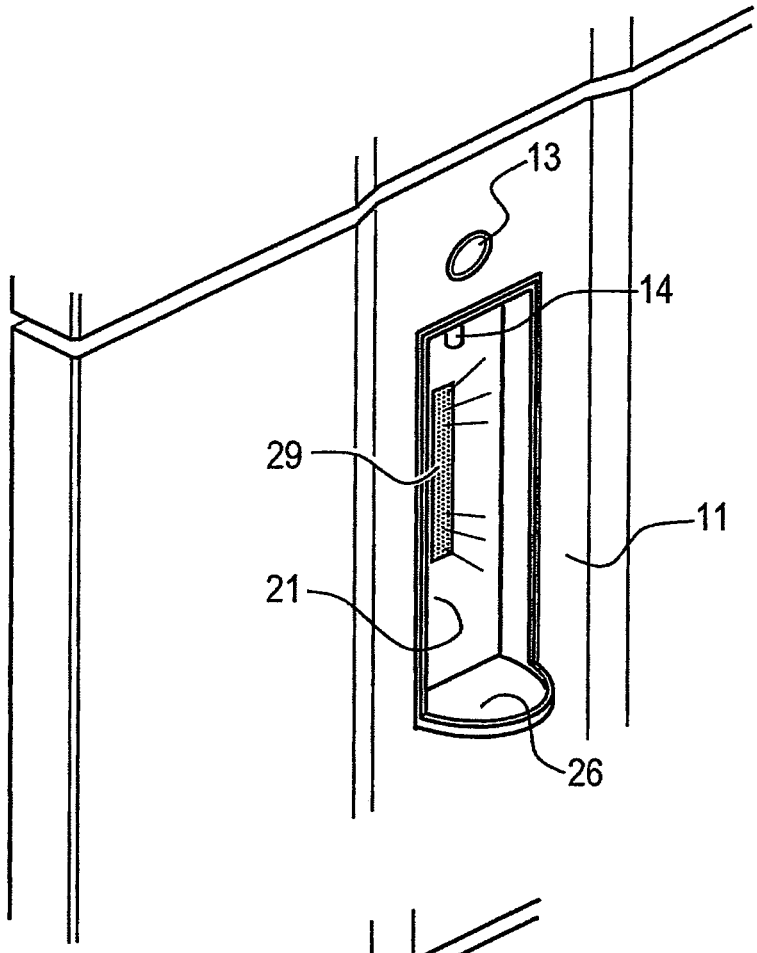
FIG. 5 shows the dispenser with the rotary assembly oriented in the usage position of the dispenser.
Figure 6:
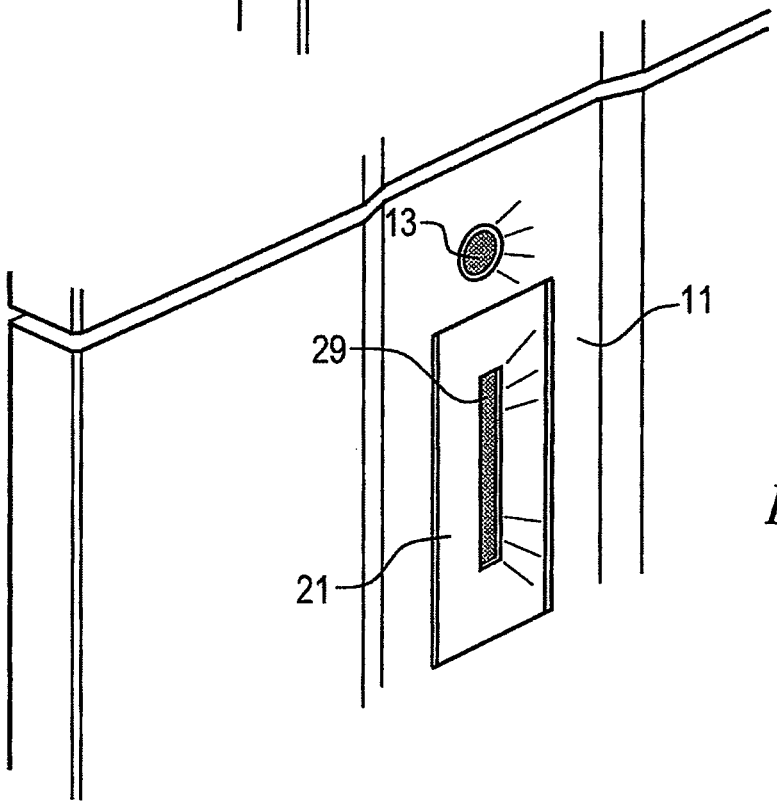
FIG. 6 shows the dispenser with the rotary assembly oriented in the closed position of the dispenser.

There are various forms of turning on the light emitters by means of the control circuit. The first form consists in activation by means of a switch whose contacts close when the rotary assembly is placed in the usage position, that is, with the flap 26 protruding outward from the plane of the front panel 11 of the cabinet door, as shown in FIG. 5. In this condition, the light passes through the translucent plate 29 and illuminates the niche where the container is placed, as well as the end 14 of the supply tube, allowing the metering of the amount of liquid sought by the user. Optionally, a light emitter element (not shown) may be associated with the supply valve control button 13, which will stay lighted together with the illumination of the niche. A second possibility includes in associating the control circuit to a presence or proximity sensing means in order to make the dispenser visible upon the user coming near the refrigerator, even with the dispenser closed. In the embodiment under discussion, the closing is achieved by rotation of the rotary assembly 20 about the cited vertical axis until reaching the position shown in FIG. 6 and detailed in FIG. 7, wherein it may be observed that the outer face of the panel 21 stays substantially closely adjacent to the plane of the outer face of the panel 12 of the refrigerator door. In this closed position, part of the light flux originated from the elements 37 (see FIG. 7) impinges on the translucent plate 29 of the panel 21 since this plate is substantially aligned or in register with the lighting subassembly 36. Thus, a user in an unlighted environment may easily locate the dispenser. Simultaneously, the control button 13 may also stay lighted in order to facilitate the operation thereof by the user. It should be noted that the proximity sensor and the control circuit comprise circuits that are known in the art and do not constitute the object of the present invention.

Notwithstanding that the invention has been described with reference to a specific exemplary embodiment, it should be understood that other forms of realization are possible to be achieved by technicians skilled in the art, still remaining within the limits of the inventive concept expressed herein. Thus, for example, the window and the corresponding translucent element 29 may have a shape that is different from the elongate rectangular shape, such as, for example, a rectangle with the ends forming semi-circles, or any other shape, with the proviso that the lighting subassembly is configured in accordance with the shape. The conductors that feed the lighting subassembly may also be held externally to the cylindrical wall 31, such as exemplified in FIG. 5, instead of being embedded in the groove 39 as illustrated in the exploded view of FIG. 4.

Figure 8:
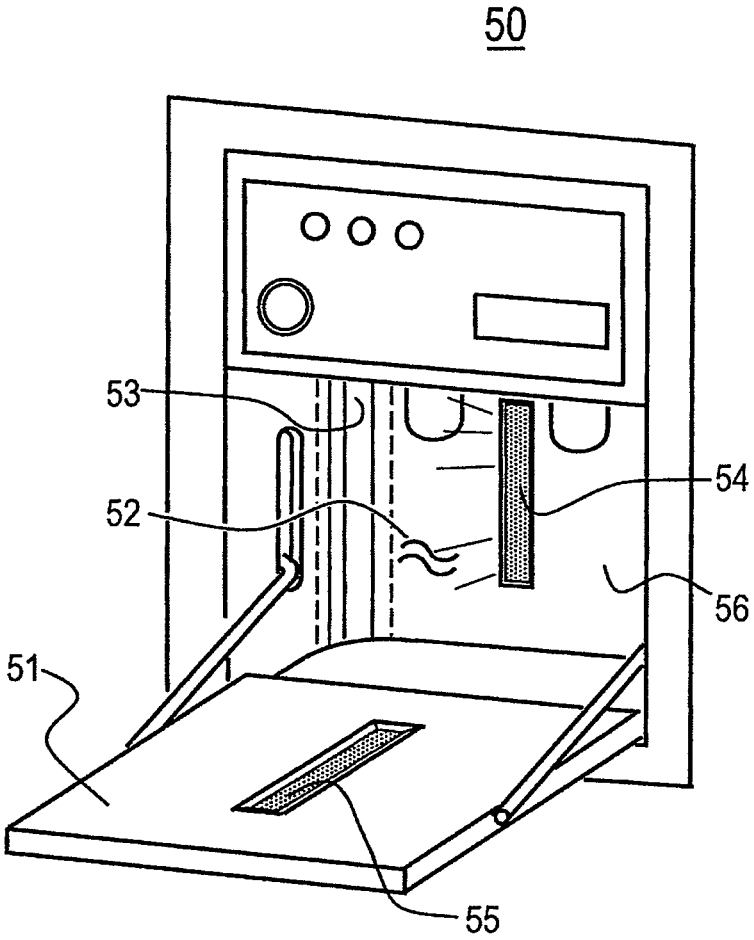
FIG. 8 shows a second embodiment of the invention, applied to a dispenser with a horizontally swinging plate, according to the principles of the invention.

Moreover, the inventive concept disclosed herein may be applied to dispensers that are structured differently from that which serves as a basis for the preceding description. In FIG. 8, there is shown the application of the invention to a dispenser whose closing means are provided by the lid/cover 51, which is able to swing about a horizontal axis. In this case, the cavity 52, which is delimited on the bottom thereof by the flat wall 55 and laterally by the curved walls 53, constitutes the niche itself wherein is inserted the container (not shown) to be filled with the liquid. As shown in the figure, the lighting of this niche originates from the translucent plate 54 that closes an opening with the same dimensions in the wall. The light emitter elements (not shown) are positioned or juxtaposed externally, that is, behind the plate. Similarly, the closing means comprising the lid/cover 51 are provided with a window, which in turn is provided with a plate 55 of translucent material, in order to render the dispenser visible when the lid/cover is closed and the lighting is activated by proximity sensing.

It is not necessary that the cavity exemplified by the embodiment shown in FIG. 8 be a circular semi-cylinder, as it may have other shapes, such as a prismatic shape, or even a cubic or parallelepiped shape, with or without rounded edges and corners.

Therefore, the invention is defined and delimited by the set of claims that follows.

The invention claimed is:

1. A liquid dispensing apparatus for use with a cabinet comprising:

a niche for accommodating a container to be filled with liquid, the niche being associated with an outer panel (12) of a cabinet and comprising closing means (21, 51) for closing an aperture in the cabinet, wherein the niche is lighted from its rear wall (21, 56) and a part of the light flux that produces the lighting impinges on an opening that includes a sheet of translucent material (29, 54) located in the closing means, wherein the niche comprises a rotary assembly (20) which rotates about a vertical axis, substantially configured in the form of a parallelepiped box of shallow depth, the rear wall of the niche being open to a face (21) of the box, said face located opposite the rear wall, and the rotary assembly being inserted in a substantially semi-cylindrical cavity (19) defined in the front of the cabinet.

2. The liquid dispensing apparatus as claimed in claim 1 wherein the rear wall (21) is provided with a window that is closed by the sheet of translucent material (29), with said sheet of translucent material (29) being juxtaposed to a lighting subassembly (36) mounted on a wall (31) of the cavity (19), when the rotary assembly (20) is oriented in a position of usage of the dispensing apparatus.

3. The liquid dispensing apparatus as claimed in claim 2, further comprising a closed position provided by the rear wall (21) when the rotary assembly (20) is oriented in a position opposite the position of usage of the dispensing apparatus.

4. The liquid dispensing apparatus as claimed in claim 3, wherein the window that is closed by the sheet of translucent material (29) is substantially aligned with the lighting subassembly (36) when the rotary assembly (20) is oriented in the closed position.

5. The liquid dispensing apparatus according to claim 1, wherein the niche is provided by a cavity (52) with its opening oriented towards the front of the cabinet, said niche being lighted from a lighting subassembly (54) installed at the rear wall thereof (56), and a closing means (51) of the cavity being provided with an aperture closed by a plate of translucent material (55) which stays substantially aligned with the lighting subassembly when the closing means are in the closed position.

6. The liquid dispensing apparatus as claimed in claim 5, wherein the lighting subassembly comprises a window closed by a sheet of translucent material (52), with at least one light emitter element mounted in juxtaposition relatively to the outer face of the window.

7. The liquid dispensing apparatus as claimed in claim 1, wherein the lighting is driven/activated by a control circuit.

8. The liquid dispensing apparatus as claimed in claim 7, wherein the control circuit comprises a proximity sensor.

9. The liquid dispensing apparatus as claimed in claim 5, wherein the lighting is driven/activated by a control circuit.

10. The liquid dispensing apparatus as claimed in claim 9, wherein the control circuit comprises a proximity sensor.

11. A refrigerator comprising the liquid dispensing apparatus of claim 1.

* * * * *

UNITED STATES PATENT AND TRADEMARK OFFICE

CERTIFICATE OF CORRECTION

PATENT NO. : 8,590,745 B2
APPLICATION NO. : 13/382948
DATED : November 26, 2013
INVENTOR(S) : Filho et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 45 days.

Signed and Sealed this
Twenty-second Day of September, 2015

Michelle K. Lee

Michelle K. Lee
*Director of the United States Patent and Trademark Office*